US007585160B2

(12) United States Patent
Hirooka et al.

(10) Patent No.: US 7,585,160 B2
(45) Date of Patent: Sep. 8, 2009

(54) HERMETIC COMPRESSOR

(75) Inventors: Katsumi Hirooka, Sakai (JP); Takashi Hikawa, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 878 days.

(21) Appl. No.: 10/517,142

(22) PCT Filed: Apr. 9, 2004

(86) PCT No.: PCT/JP2004/005185

§ 371 (c)(1),
(2), (4) Date: Dec. 7, 2004

(87) PCT Pub. No.: WO2004/092586

PCT Pub. Date: Oct. 28, 2004

(65) Prior Publication Data

US 2005/0175492 A1 Aug. 11, 2005

(30) Foreign Application Priority Data

Apr. 14, 2003 (JP) ..... 2003-109274

(51) Int. Cl.
*F04B 17/00* (2006.01)
*F04B 35/04* (2006.01)

(52) U.S. Cl. ..... 417/410.5; 417/307; 417/902; 184/6.16

(58) Field of Classification Search ..... 417/228, 417/902, 410.5, 313, 307; 184/6.16, 6.1, 184/6.13; 62/469
See application file for complete search history.

(56) References Cited

U.S. PATENT DOCUMENTS

| | | | | |
|---|---|---|---|---|
| 4,496,296 | A * | 1/1985 | Arai et al. | 418/55.5 |
| 4,889,471 | A * | 12/1989 | Izunaga et al. | 417/32 |
| 5,277,564 | A * | 1/1994 | Tamura et al. | 184/6.16 |
| 6,478,550 | B2 * | 11/2002 | Matsuba et al. | 417/310 |
| 6,709,244 | B2 * | 3/2004 | Pham | 417/292 |

FOREIGN PATENT DOCUMENTS

| | | | |
|---|---|---|---|
| JP | 4-62387 | A | 5/1992 |
| JP | 7-189959 | A | 7/1995 |
| JP | 10-148405 | A | 5/1998 |
| JP | 2000-130865 | A | 5/2000 |
| JP | 2002-227789 | A | 8/2002 |
| JP | 6-249176 | A | 9/2004 |

* cited by examiner

*Primary Examiner*—Devon C Kramer
*Assistant Examiner*—Peter J Bertheaud
(74) *Attorney, Agent, or Firm*—Global IP Counselors

(57) ABSTRACT

A hermetic compressor includes a casing, a compression mechanism in the casing, a container member and a pressure reduction device. The casing includes a high pressure chamber, an intake pipe and a discharge pipe. The high pressure chamber contains lubricant oil that is supplied to the compression mechanism. The container member is a separate body from and communicates with a bottom part of the high pressure chamber so as to allow the lubricant oil to flow to and from the container member. The pressure reduction device sucks gas refrigerant in the container member and sends it to the intake pipe for reducing an inside pressure of the container member. The pressure reduction device is in fluid communication with the intake pipe at a location between the outlet of the evaporator and an inlet of compression mechanism. A refrigerator includes the hermetic compressor.

14 Claims, 7 Drawing Sheets

HERMETIC COMPRESSOR

FIELD OF THE INVENTION

The present invention relates to a hermetic compressor and a countermeasure for preventing lubrication malfunction therein.

BACKGROUND ART

Conventionally, hermetic compressors have been widely known. For example, such hermetic compressors are provided in refrigerant circuits for refrigerators or air conditioners and are widely used for compressing refrigerants. In general, the hermetic compressors each include a casing as a sealed container and a compression mechanism accommodated within the casing. In the hermetic compressors, lubricant oil retained at the bottom of the casing is supplied to the compression mechanism and the like for lubrication.

In a hermetic compressor of this type, lubricant oil and a gas refrigerant coexist within the casing. For this reason, a considerable amount of refrigerant dissolves in the lubricant oil in a state when the external temperature is low or the like, which may lower the viscosity of the lubricant oil. When the compressor is driven under the condition that the viscosity thereof remains low, the lubricant oil of such low viscosity is supplied to the compression mechanism, which may cause lubrication malfunction and damage to the compressor.

In order to solve the above problem, countermeasures have been proposed in which the lubricant oil retained in the casing is heated to lower the amount of the refrigerant dissolving in the lubricant oil for the purpose of recovering the viscosity of the lubricant oil. For example, Japanese Laid Open Patent Application Publication No. 10-148405A discloses that an electric heater is wound around the casing and is conducted to heat the lubricant oil. Also, Japanese Laid Open Japanese Patent Application Publication No. 2000-130865A discloses that a refrigerant discharge path is provided along the outer circumference of the casing so as to heat the lubricant oil by utilizing the high temperature gas discharged from the compressor.

Problems that the Invention is to Solve

However, the above countermeasures in which the lubricant oil in the casing is heated avoid insufficiently the damage to the compressor caused by the low viscosity of the lubricant oil.

This problem will be explained in detail. In the above countermeasures, the electric heater or the high-temperature discharge gas heats the casing and indirectly heats the lubricant oil through the heated casing. The heat to be transmitted to the lubricant oil from the casing is transmitted gradually from the vicinity of the casing toward parts apart therefrom. Therefore, considerable time is required for increasing the temperature of the lubricant oil until the viscosity thereof is recovered sufficiently. For this reason, the viscosity of the lubricant oil remains low for a while even after the heating of lubricant oil starts, with a result that the lubrication malfunction for the moment remains and damage to the compressor may be invited.

The present invention has been made in view of the above disadvantages and has its object of surely avoiding lubrication malfunction caused due to lowered viscosity of the lubricant oil by dissolution of the refrigerant, and of enhancing reliability of the hermetic compressor.

SUMMARY OF THE INVENTION

The first aspect of the present invention directs to a hermetic compressor (11) provided with: a casing (20) to which an intake pipe (28) and a discharge pipe (29) are provided; and a compression mechanism (21) accommodated within the casing (20) for sucking from the intake pipe (28) and compressing a refrigerant, wherein a high pressure chamber (23) into which the refrigerant discharged from the compression mechanism (21) flows and which communicates with the discharge pipe (29) is formed within the casing (20), and lubricant oil retained at a bottom of the high pressure chamber (23) is supplied to the compression chamber (21). Further, the hermetic compressor (11) includes: a container member (31) which communicates with a bottom part of the high pressure chamber (23) so as to allow the lubricant oil to flow to and from the container member (31); and pressure reduction means or device (50) which sucks a gas refrigerant in the container member (31) and sending out the thus sucked gas refrigerant to the intake pipe (28) for reducing an inside pressure of the container member (31).

According to the second aspect of the present invention, the pressure reduction device (50) sucks the gas refrigerant in the container member (31) intermittently in the first invention.

According to the third aspect of the present invention, in the second aspect of the present invention, the pressure reduction device (50) includes a gas container (35) and a switching mechanism (51) which switches connection between a state where the gas container (35) communicates only with the intake pipe (28) and a state where the gas container (35) communicates only with the container member (31), and an operation for communicating the gas container (35) with the intake pipe (28) for pressure reduction and an operation for communicating the gas container (35) with the container member (31) are repeated alternately.

According to the fourth aspect of the present invention, in the third aspect of the present invention, the pressure reduction device (50) includes a communication pipe (34) connected to an upper end of the container member (31) and the intake pipe (28) and having the gas container (35), in the communication pipe (34) and the switching mechanism (51) is composed of opening/closing valves (36, 37) arranged respectively on sides of the gas container (35) in the communication pipe (34).

According to the fifth aspect of the present invention, in the first aspect of the present invention, the pressure reduction device (50) includes a communication pipe (34) connected to an upper end of the container member (31) and the intake pipe (28) and an adjuster valve (40) arranged in the communication pipe (34) and capable of changing a degree of opening thereof.

According to the sixth aspect of the present invention, in any of the first to the fifth aspects of the present invention, an oil supply pump (30) is provided which sucks the lubricant oil retained at the bottom of the high pressure chamber (23) and supplies it to the compression mechanism (21), and the container member (31) communicates with the high pressure chamber (23) at a part lower than a level at which the oil supply pump (30) sucks the lubricant oil.

According to the seventh aspect of the present invention, in any of the first to sixth aspects of the present invention, an electric heater (53) is provided for heating liquid in the container member (31).

The eight aspect of the present invention directs to a hermetic compressor (11) provided with: a casing (20) to which an intake pipe (28) and a discharge pipe (29) are provided; and a compression mechanism (21) accommodated within the casing (20) for sucking from the intake pipe (28) and compressing a refrigerant, wherein a high pressure chamber (23), into which the refrigerant discharged from the compression mechanism (21) flows and which communicates with the discharge pipe (29) is formed within the casing (20), and in which lubricant oil retained at a bottom of the high pressure chamber (23) is supplied to the compression chamber (23). Further, the hermetic compressor (11) includes: a pressure reduction device (50) which sucks a gas refrigerant in the high pressure chamber (23) and sends it to the intake pipe (28) for temporally reducing an inside pressure of the high pressure chamber (23).

According to the ninth aspect of the present invention, in the eighth aspect of the present invention, the pressure reduction device (50) includes a gas container (35) and a switching mechanism (53) which switches connection between a condition that the gas container (35) communicates only with the intake pipe (28) and a condition that the gas container (35) communicates only with the high pressure chamber (23), and an operation for communicating the gas container (35) with the intake pipe (28) for pressure reduction and an operation for communicating the gas container (35) with the high pressure chamber (23) are repeated alternately to suck the gas refrigerant in the high pressure chamber (23) intermittently.

Operation

In the first aspect of the present invention, the compression mechanism (21) is accommodated within the casing (20) of the hermetic compressor (11). The compression mechanism (21) sucks the refrigerant flowing in the casing (20) through the intake pipe (28) and discharges the compressed refrigerant to the high pressure chamber (23). The refrigerant discharged to the high pressure chamber (23) is sent outside the casing (20) through the discharge pipe (29). The inside pressure of the high pressure chamber (23) is equal to the pressure of the refrigerant discharged from the compression mechanism (21), namely is high. The lubricant oil is retained at the bottom of the high pressure chamber (23) and is supplied to the compression mechanism (21).

The high pressure chamber (23) communicates at the bottom thereof with the container member (31). The lubricant oil in the high pressure chamber (23) flows to and from the container member (31). In other words, the pressure in the container member (31) is high as well as that in the high pressure chamber (23). The hermetic compressor (11) is provided with pressure reduction v (50). When the viscosity of the lubricant oil becomes low due to dissolution of a considerable amount of refrigerant into the lubricant oil for example, the pressure reduction device (50) sucks the gas refrigerant in the container member (31) to introduce it into the intake pipe (28). In detail, the pressure reduction device (50) sucks the gas refrigerant from the container member (31) by utilizing the intake pipe (28) of which pressure becomes low during the operation of the hermetic compressor (11).

The suction of the gas refrigerant in the container member (31) by the pressure reduction device (50) reduces the inside pressure of the container member (31), which immediately reduces the pressure of the lubricant oil in the container member (31) and the dissolubility of the refrigerant to the lubricant oil is lowered. Accordingly, the amount of the refrigerant dissolving in the lubricant oil is reduced, so that the viscosity of the lubricant oil is recovered. The lubricant oil of which viscosity is thus recovered returns to the high pressure chamber (23) from the container member (31) and is utilized for lubrication in the compression mechanism (21).

In the second aspect of the present invention, the pressure reduction means (50) sucks the gas refrigerant in the container member (31) intermittently. During the suction of the gas refrigerant by the pressure reduction device (50), the inside pressure of the container member (31) is reduced and the refrigerant dissolving in the lubricant oil in the container member (31) is gasified, thereby recovering the viscosity of the lubricant oil. To the contrary, when the pressure reduction device (50) halts the suction of the gas refrigerant, the inside pressure of the container member (31) increases, so that the lubricant oil, of which viscosity has been recovered, returns to the high pressure chamber (23) from the container member (31).

In the third aspect of the present invention, the gas container (35) and the switching mechanism (51) are provided in the pressure reduction device (50). The switching mechanism (51) operates to switch the connection of gas container (35) between the condition that the gas container (35) communicates only with the intake pipe (28) and the condition that the gas container (35) communicates only with the container member (31). When the gas container (35) communicates with the intake pipe (28), the gas refrigerant in the gas container (35) is introduced to the intake pipe (28) to reduce the inside pressure of the gas container (35). Then, when the gas container (35), of which inside pressure has been reduced, communicates with the container member (31), the gas refrigerant in the container member (31) is introduced to the gas container (35) to reduce the inside pressure of the container member (31). When the inside pressure of the container member (31) is reduced, the refrigerant dissolving in the lubricant oil is gasified.

In the fourth aspect of the present invention, the communication pipe (34) is provided in the pressure reduction device (50). The communication pipe (34) is connected to the upper end of the container member (31) and the intake pipe (28). The gas container (35) is arranged in the communication pipe (34). The opening/closing valves (36, 37) serving as the switching mechanism (51) are provided in the communication pipe (34) on the upper stream side and the downstream side of the gas container (35), respectively.

When the opening/closing valve (36) on the container member (31) side is closed and the opening/closing valve (37) on the intake pipe (28) side is opened in the pressure reduction device (50), the gas container (35) communicates with the intake pipe (28) to reduce the pressure in the gas container (35). To the contrary, when the opening/closing valve (36) on the container member (31) side is opened and the opening/closing valve (37) on the intake pipe (28) side is closed in the pressure reduction device (50), the gas container (35) communicates with the container member (31), so as to reduce the pressure in the container member (31).

In the fifth aspect of the present invention, the communication pipe (34) and the adjuster valve (40) is provide in the pressure reduction device (50). The adjuster valve (40) is arranged in the communication pipe (34). When the adjuster valve (40) is opened, the gas refrigerant in the container member (31) is sucked out into the intake pipe (28) through the communication pipe (34). Accordingly, the inside pressure of the container member (31) is reduced, to gasify the refrigerant dissolving in the lubricant oil in the container member (31), with a result that the viscosity of the lubricant oil is recovered.

In the sixth aspect of the present invention, the oil supply pump (30) supplies the lubricant oil to the compression mechanism (21). In detail, the oil supply pump (30) sucks the lubricant oil retained at the bottom of the high pressure chamber (23) and supplies it to the compression mechanism (21). In this invention, the container member (31) communicates with the high pressure chamber (23) at a part lower than the level of the sucking portion of the oil supply pump (30). In other words, the oil supply pump (30) sucks the lubricant oil from a part above the level at which the container member (31) communicates.

It should be noted that there is a case where the refrigerant does not dissolve in the lubricant oil and the liquid refrigerant and the lubricant oil separate into two layers according to the temperature or the pressure. In general, because the liquid refrigerant is higher in density than the lubricant oil, the layer of the liquid refrigerant is located below the layer of the lubricant oil in the two-layer separation. In such a case, the liquid refrigerant mainly flows into the container member (31). When the pressure reduction device (50) reduces the inside pressure of the container (31), the liquid refrigerant flown in the container member (31) is evaporated to be sent into the intake pipe (28). Thus, the boundary of the two-layer separation between the liquid refrigerant and the lubricant oil is avoided to be located above the level at which the high pressure chamber (23) communicates with the container member (31), with a result that the oil supply pump (30) sucks the lubricant oil even in the state of two-layer separation.

In the seventh aspect of the present invention, the electric heater (53) is provided to the hermetic compressor (11). As stated above, the pressure reduction device (50) reduces the pressure in the container member (31) by utilizing the intake pipe (28) of which pressure becomes lower during the operation of the hermetic compressor (11). In other words, the pressure reduction device (50) reduces the pressure in the container member (31) only during the operation of the hermetic compressor (11). In contrast, when the electric heater (53) is conducted, the lubricant oil in the container member (31) is heated independent from the operation of the hermetic compressor (11), so that the lubricant oil in the container member (31) is heated and the refrigerant dissolving in the lubricant oil is gasified. In addition, if the liquid refrigerant remains in the container member (31) in the state of two-layer separation of the liquid refrigerant and the lubricant oil, the liquid refrigerant heated by the electric heater (53) is evaporated.

In the eighth aspect of the present invention, the compression mechanism (21) is accommodated within the casing (20) of the hermetic compressor (11). The compression mechanism (21) sucks the refrigerant flown in the casing (20) through the intake pipe (28) and discharges the compressed refrigerant to the high pressure chamber (23). The refrigerant discharged to the high pressure chamber (23) is sent outside the casing (20) through the discharge pipe (29). The inside pressure of the high pressure chamber (23) is equal to the pressure of the refrigerant discharged from the compression mechanism (21), namely, is high. Also, the lubricant oil retained at the bottom of the high pressure chamber (23) is supplied to the compression mechanism (21).

Further, the hermetic compressor (11) is provided with the pressure reduction device (50). When the viscosity of the lubricant oil is lowered, for example, by dissolution of a considerable amount of refrigerant into the lubricant oil, the pressure reduction device (50) sucks the gas refrigerant in the high pressure chamber (23) to introduce it to the intake pipe (28). In other words, the pressure reduction device (50) sucks the gas refrigerant from the high pressure chamber (23) by utilizing the intake pipe (28) of which pressure becomes lower during the operation of the hermetic compressor (11).

When the pressure reduction device (50) sucks the gas refrigerant in the high pressure chamber (23), the inside pressure of the high pressure chamber (23) is temporarily lowered. The lowering of the inside pressure of the high pressure chamber (23) immediately reduces the pressure of the lubricant oil in the high pressure chamber (23), with a result of lowering the dissolubility of the refrigerant to the lubricant oil. For this reason, the amount of the refrigerant dissolving in the lubricant oil is reduced and the viscosity of the lubricant oil is recovered.

In the ninth aspect of the present invention, the gas container (35) and the switching mechanism (51) are provided in the pressure reduction device (50). The switching mechanism (51) switches the connection of the gas container (35) between the condition that the gas container (35) communicates only with the intake pipe (28) and the condition that the gas container (35) communicates only with the high pressure chamber (23). When the gas container (35) communicates with the intake pipe (28), the gas refrigerant in the gas container (35) is sucked out into the intake pipe (28) to reduce the inside pressure of the gas container (35). Then, when the gas container (35), of which inside pressure has been reduced, communicates with the high pressure chamber (23), the gas refrigerant in the high pressure chamber (23) is sucked out into the gas container (35) to reduce the inside pressure of the high pressure chamber (23). When the inside pressure of the high pressure chamber (23) is reduced, the refrigerant dissolving in the lubricant oil in the high pressure chamber (23) is gasified.

According to the hermetic compressor (11) of the present invention, the pressure reduction device (50) sucks the gas refrigerant in the container member (31) to reduce the inside pressure of the container member (31). When the inside pressure of the container member (31) is reduced, the pressure of the lubricant oil is immediately reduced and the dissolubility of the refrigerant to the lubricant oil is also lowered. In turn, the refrigerant dissolving in the lubricant oil is gasified, with a result that the viscosity of the lubricant oil is instantly recovered. Hence, the refrigerant dissolving in the lubricant oil is gasified and the viscosity thereof is recovered in shorter period in the present invention than that in the conventional case where the refrigerant dissolving in the lubricant oil is gasified by heating the lubricant oil by a heater wound around the casing (20). As a result, lubrication malfunction caused due to lowering of the viscosity of the lubricant oil by dissolution of the refrigerant thereto can be surely avoided and the reliability of the hermetic compressor (11) can be enhanced.

Further, according to the hermetic compressor (11) in the third embodiment, the switching mechanism (51) operates to communicate the gas container (35), of which inside pressure is reduced, with the container member (31), so that the inside pressure of the container member (31) is reduced. In other words, the container member (31) does not directly communicate with the intake pipe (28) though the inside pressure of the container member (31) is reduced by utilizing the intake pipe (28) of reduced pressure in the hermetic compressor (11). For this reason, the inside pressure of the container member (31) is not so reduced as that of the intake pipe (28) even under reduced pressure, which prevents excessive flow of the lubricant oil to the container member (31). Thus, according to the present invention, the level of the lubricant oil in the high pressure chamber (23) is prevented from being excessively lowered at the pressure reduction in the container member (31), whereby the oil supply pump (30) can surely continue to supply the lubricant oil in the high pressure chamber (23) to the compression mechanism (21).

Further, according to the sixth aspect of the present invention, the container member (31) is arranged so as to communicate with the hermetic compressor (11) at a part lower than the level at which the oil supply pump (30) sucks the lubricant oil. Also, in the state of two- layer separation of the liquid refrigerant and the lubricant oil, the liquid refrigerant in the high pressure chamber (23) flowing in the container member (31) is evaporated. Thus, the boundary between the liquid refrigerant and the lubricant oil in the tow-layer separation does not reach the level above the part where the high pressure chamber (23) communicates with the container member (31), so that the oil supply pump (30) always supplies the lubricant oil. Thus, according to the present invention, the oil supply pump (30) is prevented from supplying the liquid refrigerant in the two-layer separation to the compression mechanism (21), with a result that the lubrication malfunction in the compression mechanism (21) can be surely prevented and the reliability of the hermetic compressor (11) can be enhanced.

In addition, according to the seventh aspect of the present invention, the conduction of the electric heater (53) heats the lubricant oil in the container member (31), independent from the operation of the hermetic compressor (11), to gasify the refrigerant dissolving in the lubricant oil, which recovers the viscosity of the lubricant oil. Moreover, the electric heater (53) heats the liquid refrigerant in the container member (31) to evaporate it even in the two- layer separation of the liquid refrigerant and the lubricant oil. Hence, according to the present invention, the conduction of the electric heater (53) before activation enables to recover the viscosity of the lubricant oil, which surely prevents the lubrication malfunction in the compression mechanism (21) immediately after the activation and further enhances the reliability of the sealed compression mechanism (11).

PREFERRED EMBODIMENT OF THE INVENTION

Embodiments of the present invention will be described hereinafter in detail with reference to accompanying drawings.

First Embodiment

The present embodiment refers to a refrigerator (1) provided with a hermetic compressor (11) according to the present invention.

<Whole Structure of the Refrigerator>

Figure 1:
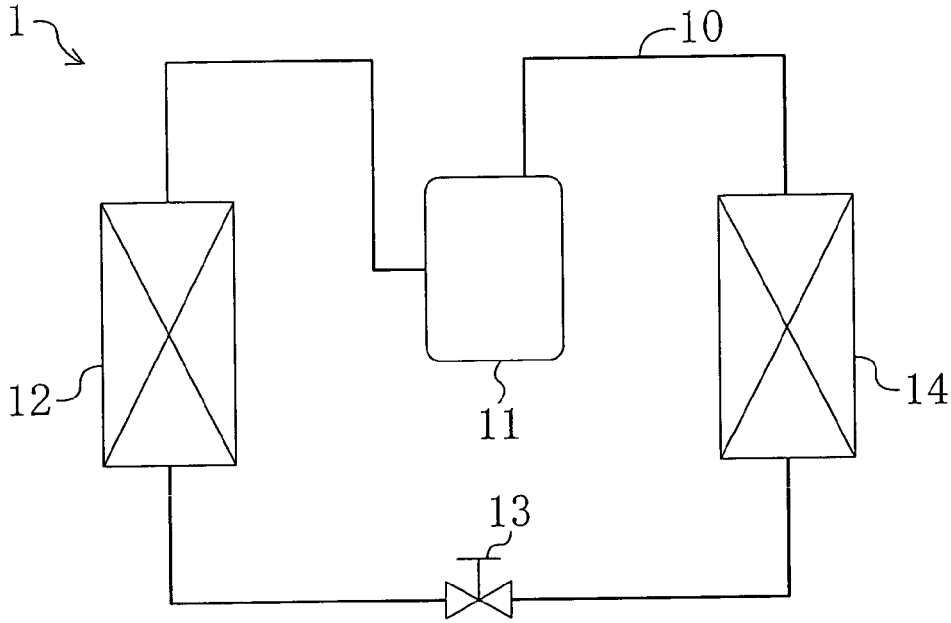
FIG. 1 is a schematic diagram showing the structure of a refrigerator according to a first embodiment.

As shown in FIG. 1, the refrigerator (1) is provided with a refrigerant circuit (10) that is a closed circuit so composed that the hermetic compressor (11), a condenser (12), an expansion valve (13) and an evaporator (14) are sequentially connected through pipes. In the refrigerant circuit (10), R410A, R407C or the like, which are HFC refrigerants, is filled as a refrigerant.

<Structure of Compressor>

Figure 2:
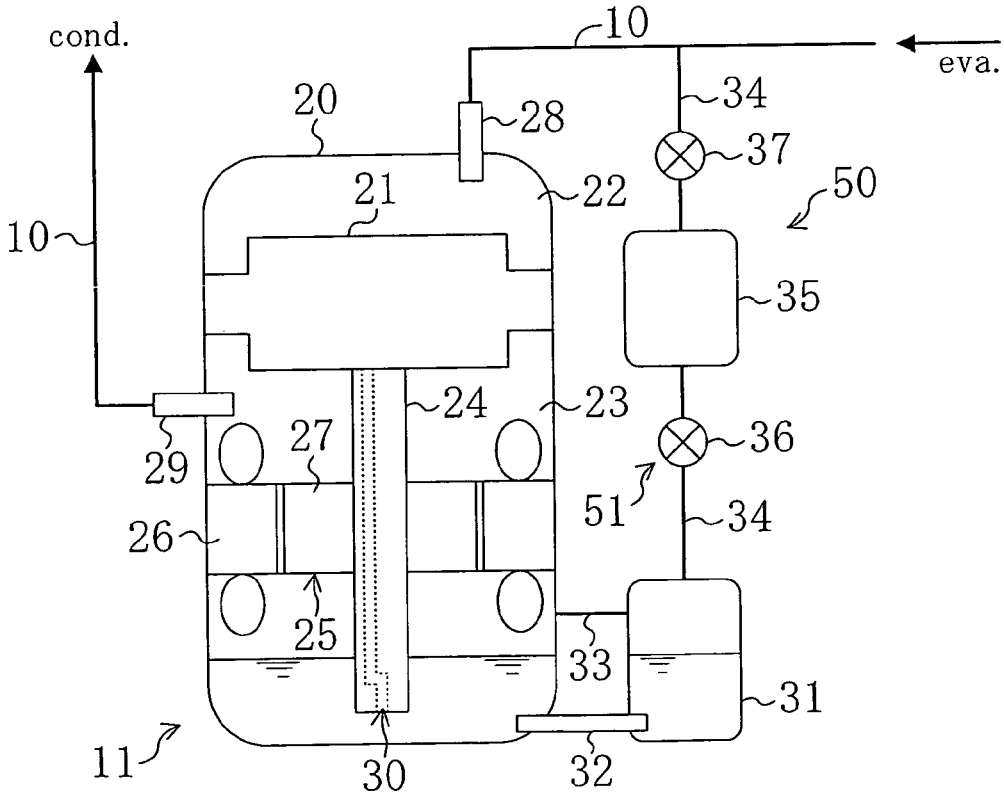
FIG. 2 is a schematic diagram showing the structure of a hermetic compressor according to the first embodiment.

As shown in FIG. 2, the hermetic compressor (11) has a closed structure as a whole, and includes a longitudinal, cylindrical casing (20).

A compression mechanism (21) and an electric motor (25) are provided within the casing (20). The compression mechanism (21) is connected to the electric motor (25) by means of a vertically extending drive shaft (24).

The compression mechanism (21) is of scroll type fluid mechanism and includes a fixed scroll and a rotary scroll, though not shown. The compression mechanism (21) divides the inside of the casing (20) into two spaces of upper and lower spaces. The space upper than the compressor mechanism (21) serves as a low pressure chamber (22) and the space lower than the compression mechanism (21) serves as a high pressure chamber (23).

An intake pipe (28) is provided at the upper end of the casing (20) so as to be open to the low pressure chamber (22). A discharge pipe (29) is provided at the side of the casing (20) so as to be open to the high pressure chamber (21). The compression mechanism (21) sucks and compresses the refrigerant flown in the low pressure chamber (22) through the intake pipe (28), and then, discharges the thus compressed refrigerant to the high pressure chamber (23).

The electric motor (25) is provided within the high pressure chamber (23) and includes a fixed stator (26) and a rotor (27). The stator (26) is fixed to the inner circumference of the casing (20), while the rotor (27) is arranged inside the stator (26) and is fixed to the drive shaft (24). When the electric motor (25) is conducted, the rotor (27) rotates to drive the drive shaft (24).

The drive shaft (24) engages at the upper end thereof with the rotary scroll of the compression mechanism (21). An oil supply path (30) of which lower end is open is formed at the drive shaft (24) so as to extend in the axial direction thereof. The oil supply path (30) has a portion extending in the radial direction of the drive shaft (24) so as to constitute an oil supply pump for sucking the lubricant oil by so-called centrifugal pump operation.

The lubricant oil is retained at the bottom of the casing (20), that is, at the bottom of the high pressure chamber (23). The pressure of the lubricant oil retained in the high pressure chamber (23) is equal to the pressure of high temperature, high pressure gas refrigerant discharged from the compression mechanism (21), that is, equal to the high pressure of refrigeration cycle. The lubricant oil is sucked into the oil supply path (30) composing the oil supply pump from the lower end of the drive shaft (24) and is supplied to the compression mechanism (21) through the oil supply path (30).

The high pressure chamber (23) communicates at the bottom thereof with a liquid retainer (31) through an oil return pipe (32). The liquid retainer (31) composes a container member formed of a hollow cylinder in a sealed state. One end of the oil return pipe (32) is open at a part lower than the level where the oil supply path (30) composing the oil supply pump sucks the refrigerant, namely at a part lower than the lower end of the drive shaft (24). The oil return pipe (32) is arranged substantially horizontally so that the lubricant oil in the high pressure chamber (23) can flow to and from the liquid retainer (31).

The liquid retainer (31) is connected at the upper part thereof to a gas connection pipe (33). One end of the gas connection pipe (33) is open at a part always above the oil level of the lubricant oil in the high pressure chamber (23). In other words, the upper part of the liquid retainer (31) is connected through the gas connection pipe (33) to a part where the gas refrigerant always exists in the high pressure chamber (23).

The liquid retainer (31) is connected at the upper end thereof to one end of the communication path (34), of which other end is connected to the intake pipe (28) through the refrigerant circuit (10). A gas container (35) is provided in the communication pipe (34) and is formed of a hollow cylinder in a sealed state. The communication pipe (34) is connected to the upper end and the lower end of the gas container (35).

First and second solenoid valves (36, 37) as opening/closing valves are respectively provided on the sides of the gas container (35) in the communication pipe (34). Specifically, in the communication pipe (34), the first solenoid valve (36) is provided on the liquid retainer (31) side of the gas container (35) and the second solenoid valve (37) is provided on the intake pipe (28) side of the gas container (35). The communication pipe (34), the gas container (35), the first solenoid valve (36) and the second solenoid valve (37) compose pressure reduction means (50).

In the hermetic compressor (11), there are provided a temperature sensor for detecting the temperature of the lubricant oil, a pressure sensor for measuring the pressure of the gas refrigerant discharged from the discharge pipe (29), and an oil level sensor for detecting the oil level of the lubricant oil retained at the bottom of the high pressure chamber (23). The sensors are not shown in the drawings.

Driving Operation

When the hermetic compressor (11) operates, the refrigerant circulates in the refrigerant circuit (10) to perform vapor compression refrigeration cycle. At that time, the hermetic compressor (11) sucks and compresses the gas refrigerant of low pressure evaporated by the evaporator (40), and then, sends the thus compressed gas refrigerant, of which pressure has become high, to the condenser (12). The driving operation of the hermetic compressor (11) will be described here.

When the electric motor (25) is conducted, the rotor (27) rotates to drive the drive shaft (24). The rotary scroll engaging with the drive shaft (24) is driven and rotated in the compression mechanism (21). The gas refrigerant from the evaporator (14) is sucked into the low pressure chamber (22) in the casing (20) through the intake pipe (28). The gas refrigerant sucked in the low pressure chamber (22) is sent to the compression mechanism (21) to be compressed. The gas refrigerant of high temperature and high pressure compressed in the compression mechanism (21) is once discharged into the high pressure chamber (23), and then, is discharged outside the casing (20) through the discharge pipe (29). The refrigerant after circulated in the refrigerant circuit (10) is sucked again into the casing (20) through the intake pipe (28).

When the drive shaft (24) rotates, the lubricant oil retained at the bottom of the high pressure chamber (23) is sucked into the oil supply path (30) from the lower end of the drive shaft (24). The lubricant oil flows upward through the oil supply path (30) to be supplied into the compression mechanism (21). The lubricant oil in the compression mechanism (21) after lubrication drops down to the bottom of the high pressure chamber (23).

Since the lubricant oil and the gas refrigerant coexist in the high pressure chamber (23), a considerable amount of refrigerant may dissolve in the lubricant oil according to the temperature of the lubricant oil and the pressure of the gas refrigerant, which may lower the viscosity of the lubricant oil. Therefore, the temperature sensor obtains the temperature of the lubricant oil and the pressure sensor obtains the pressure of the gas refrigerant during the operation of the hermetic compressor (11) so as to always monitor the state of the lubricant oil as to whether the viscosity thereof is maintained to an appropriate value.

Figure 3:
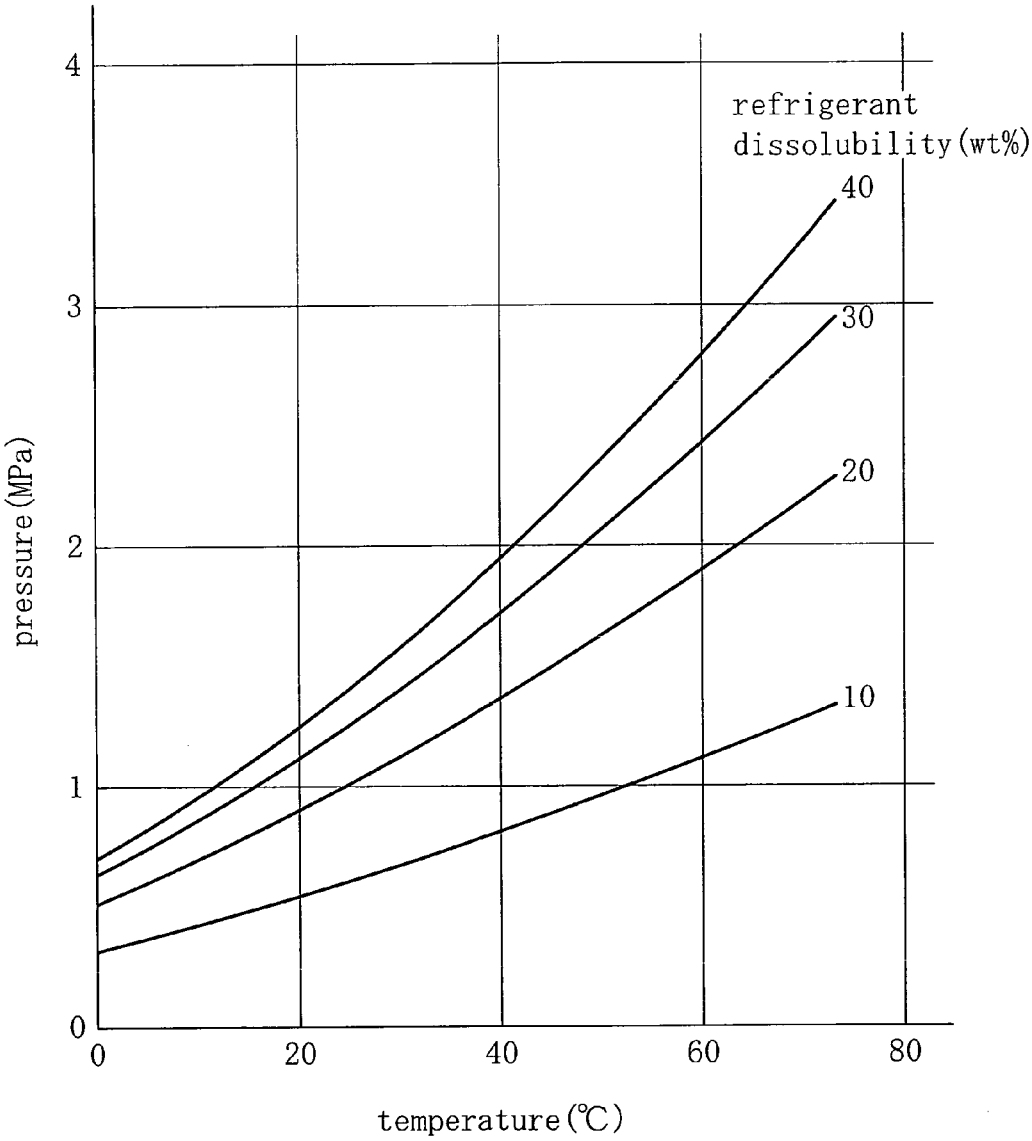
FIG. 3 is a graph showing the relationship among the temperature of lubricant oil, the pressure of a refrigerant and the dissolubility of the refrigerant.
Figure 4:
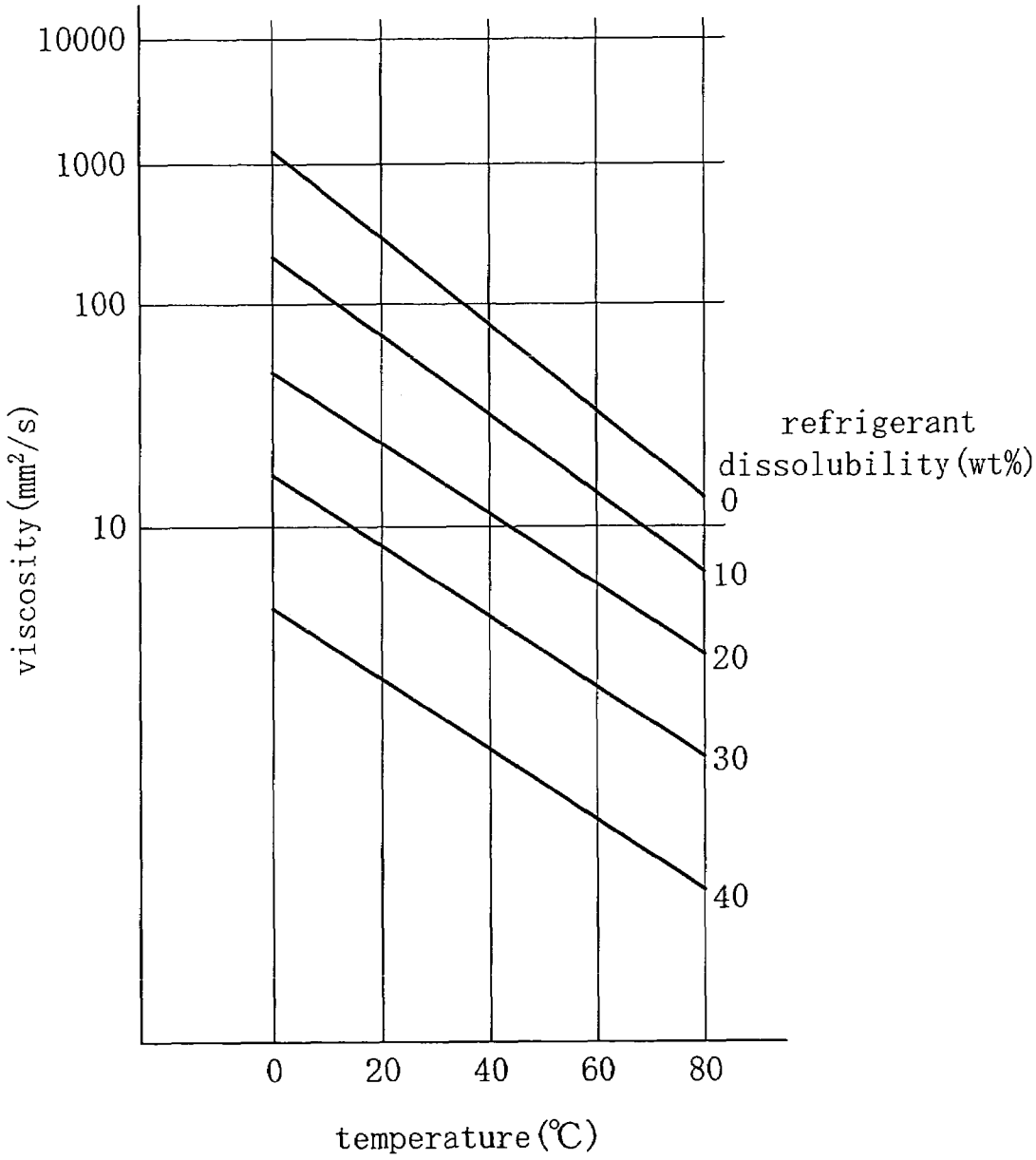
FIG. 4 is a graph showing the relationship among the temperature and the viscosity of the lubricant oil and the dissolubility of the refrigerant.

As shown in FIG. 3, in the case where the kinds of the lubricant oil and the refrigerant are specified, the dissolubility of the refrigerant to the lubricant oil (i.e., refrigerant dissolubility) is necessarily determined according to the values of the temperature and the pressure. Also, as shown in FIG. 4, the viscosity of the lubricant oil is necessarily determined according to the values of the temperature and the registrant dissolubility. In other words, the viscosity of the lubricant oil can be estimated according to the values of the temperature of the lubricant oil retained in the high pressure chamber (23) and the pressure of the refrigerant, by referencing the relationships shown in FIG. 3 and FIG. 4.

Appropriate viscosity of the lubricant oil, which is determined according to the values of the temperature of the lubricant oil and the pressure of the gas refrigerant, is set beforehand as a reference viscosity for comparing the reference viscosity with a viscosity of the lubricant oil obtained from the detected values of the temperature sensor and the pressure sensor. When the viscosity of the lubricant oil obtained from the detected values of the temperature sensor and the pressure sensor is lower than the reference viscosity, it is judged that the appropriate viscosity of the lubricant oil is not maintained and the first solenoid valve (36) and the second solenoid valve (37) are alternately opened, thereby recovering the viscosity of the lubricant oil. Each operation of the first and second solenoid valves (36, 37) will be described next.

When the viscosity of the lubricant oil obtained from the detected values of the temperature sensor and the pressure sensor is higher than the reference viscosity, the first solenoid valve (36) is closed and the second solenoid valve (37) is opened. In other words, the gas container (35) communicates with the intake pipe (28) and the inside pressure of the gas container (35) is equal to the pressure in the intake pipe (28). Also, the inside pressure of the liquid retainer (31) is equal to the pressure of the gas refrigerant discharged from the compression mechanism (21).

To the contrary, when the viscosity of the lubricant oil obtained from the detected values of the temperature sensor and the pressure sensor becomes lower than the reference viscosity, the first solenoid valve (36) and the second solenoid valve (37) are alternately opened and closed to reduce the pressure in the liquid retainer (31) intermittently.

First, when the first solenoid valve (36) is opened and the second solenoid valve (37) is closed, the gas container (35), of which pressure is low by communication with the intake pipe (28), communicates with the liquid retainer (31). In association therewith, the gas refrigerant in the liquid retainer (31) is introduced to the gas container (35) through the communication path (34) to reduce the inside pressure of the liquid retainer (31). When the inside pressure of the liquid retainer (31) is reduced, the lubricant oil in the high pressure chamber (23) flows into the liquid retainer (31) and the pressure of the lubricant oil in the liquid retainer (31) is reduced, whereby the dissolubility of the refrigerant to the lubricant oil is lowered. Thus, the refrigerant dissolving in the lubricant oil is gasified, with a result that the viscosity of the lubricant oil in the liquid retainer (31) is recovered.

Next, when the first solenoid valve (36) is closed and the second solenoid valve (37) is opened, the liquid retainer (31) is disconnected from the gas container (35) while the gas container (35) communicates with the intake pipe (28). The gas refrigerant sucked out from the liquid retainer (31) to the gas container (35) is introduced to the intake pipe (28) through the communication pipe (34). During the time when the first solenoid valve (36) is closed, the gas refrigerant in the high pressure chamber (23) gradually flows into the liquid retainer (31) through the gas connection pipe (33), so that the inside pressure of the liquid retainer (31) gradually approximates to the inside pressure of the high pressure chamber (23). In association therewith, the oil level of the lubricant oil in the liquid retainer (31) lowers to the same level as the oil level of the lubricant oil in the high pressure chamber (23). Then, the lubricant oil in the liquid retainer (31), of which viscosity has been recovered, is sent back to the high pressure chamber (23) through the oil return pipe (32).

Thereafter, when the first solenoid valve (36) is opened and the second solenoid valve (37) is closed again, the gas container (35), of which pressure has been reduced, communicates with the liquid retainer (31) to reduce the inside pressure of the liquid retainer (31). Accordingly, the lubricant oil in the high pressure chamber (23) flows into the liquid retainer (31) and the pressure of the lubricant oil in the liquid retainer (31) is reduced, with a result that the refrigerant dissolving in the lubricant oil is gasified to recover the viscosity of the lubricant oil. Then, when the first solenoid valve (36) is closed and the second solenoid valve (37) is opened again, the inside pressure of the liquid retainer (31) is increased and the lubricant oil in the liquid retainer (31), of which viscosity has been recovered, is sent back to the high pressure chamber (23).

In this way, when the first solenoid valve (36) and the second solenoid valve (37) are opened and closed, the lubricant oil retained in the high pressure chamber (23) is sent to the liquid retainer (31) and the lubricant oil, of which viscosity has been recovered by the gasification of the refrigerant, is sent back to the high pressure chamber (23). Repetition of the opening/closing operations of the first solenoid valve (36) and the second solenoid valve (37) reduces the amount of the refrigerant dissolving in the lubricant oil in the high pressure chamber (23) to gradually recover the viscosity of the lubricant oil, with a result that the viscosity of the lubricant oil in the high pressure chamber (23) is maintained equal to or higher than the reference viscosity.

It is noted that the alternate opening/closing operations of the first solenoid valve (36) and the second solenoid valve (37) continue until the viscosity of the lubricant oil obtained from the detected values of the temperature sensor and the pressure sensor becomes higher than the reference viscosity, that is, until the viscosity of the lubricant oil is recovered.

Wherein, the oil level of the lubricant oil in the high pressure chamber (23) may become lower than the lower end of the drive shaft (24) by reducing the pressure in the liquid retainer (31) when the amount of the lubricant oil retained in the high pressure chamber (23) is less. In this situation, no lubricant oil is supplied to the oil supply path (30) in the drive shaft (24), which may invite damage to the compression mechanism (21). Therefore, the first solenoid valve (36) is kept closed to maintain the high pressure in the liquid retainer (31) when it is judged based on an output of the oil level sensor that the oil level becomes lower.

Moreover, there may be a case of two-layer separation of liquid refrigerant and the lubricant oil where the refrigerant does not dissolve in the lubricant oil according to the temperature of the lubricant oil or the pressure of the gas refrigerant. When the boundary between the liquid refrigerant and the lubricant oil in this state is above the lower end of the drive shaft (24), the liquid refrigerant of the lower layer is sent to the oil supply path (30) in the drive shaft (24), which may invite damage to the compression mechanism (21). Therefore, the temperature sensor and the pressure sensor always monitor, during the operation of the hermetic compressor (11), the state as to whether the liquid refrigerant and the lubricant oil separate in two layers.

Figure 5:
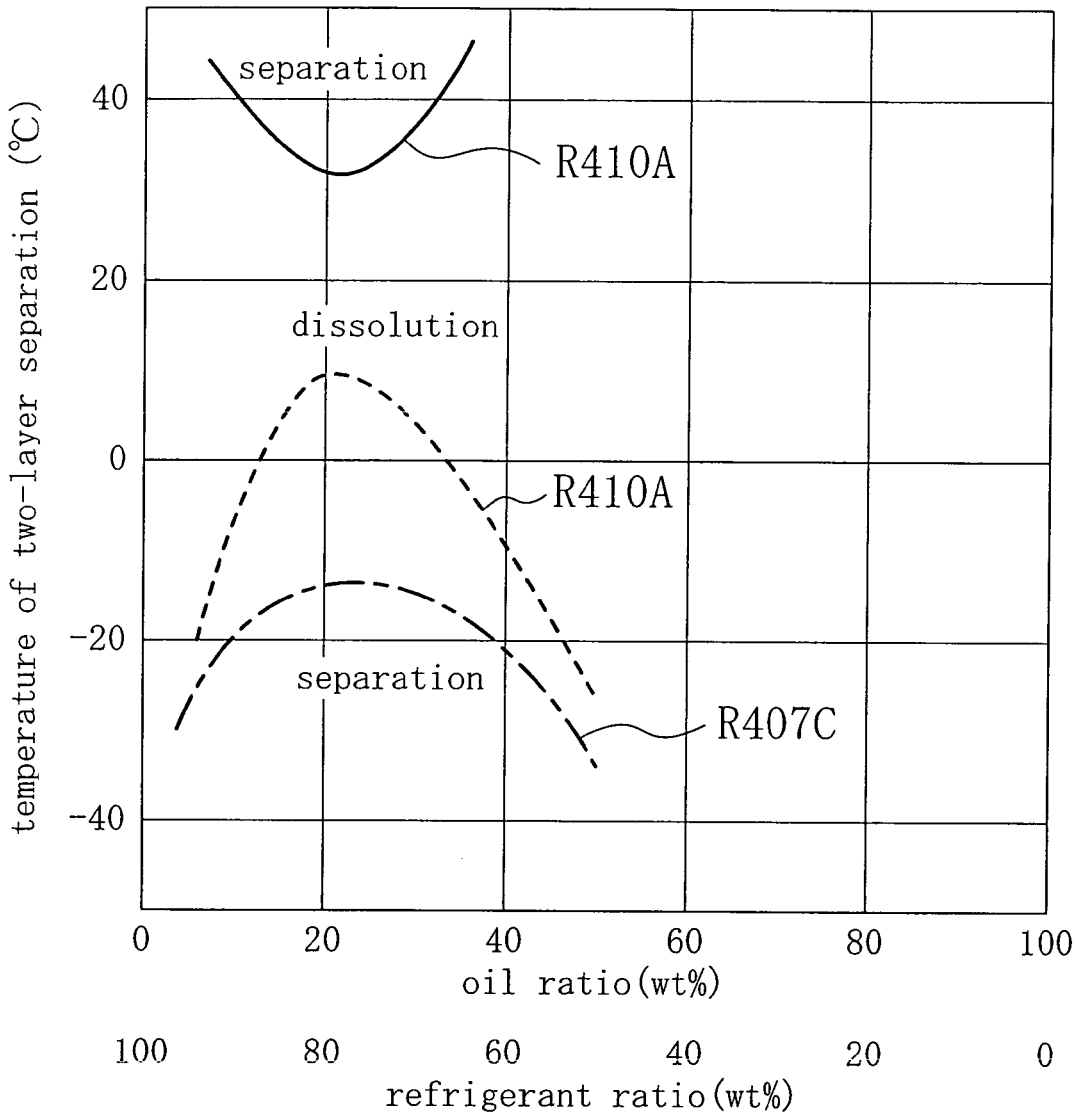
FIG. 5 is a graph showing the relationship among the dissolubility of refrigerants, the temperature of the lubricant oil and the kinds of the refrigerants.

As described above, according to the values of the temperature of the lubricant oil and the pressure of the gas refrigerant, the refrigerant dissolubility can be estimated based on the relationship shown in FIG. 3. Also, if the materials of lubricant oil and refrigerant are specified, the state of the lubricant oil and the refrigerant, that is, whether the lubricant oil and the refrigerant separate or the refrigerant dissolves in the lubricant oil can be determined according to the dissolubility of the refrigerant to the lubricant oil and the value of the temperature of the lubricant oil, as shown in FIG. 5. For example, suppose that the refrigerant is R410A. When a point determined according to the temperature of the lubricant oil and the refrigerant dissolubility, i.e., a ratio of the refrigerant to the lubricant oil in which the refrigerant dissolves is in the range below the solid line and above the broken line, the refrigerant dissolves in the lubricant oil. To the contrary, the liquid refrigerant and the lubricant oil separate in two layers when a point determined according to the temperature of the lubricant oil and the refrigerant dissolubility is in the range above the solid line or below the broken line. Further, suppose that the refrigerant is R407C. The refrigerant dissolves in the lubricant oil when a point determined according to the temperature of the lubricant oil and the refrigerant dissolubility is in the range above the dash-dot line, and the liquid refrigerant and the lubricant oil separate in two layers when a point determined according to the temperature of the lubricant oil and the refrigerant dissolubility is in the range below the dash-dot line. In this way, according to the values of the temperature of the lubricant oil and the pressure of the gas refrigerant retained in the high pressure chamber (23), whether the lubricant oil and the refrigerant separate in two layers or not can be judged by referencing the values and the relationships show in FIG. 3 and FIG. 5.

When it is judged according to the detected values of the temperature sensor and the pressure sensor that the liquid refrigerant and the lubricant oil separate in two layers, the first solenoid valve (36) and the second solenoid valve (37) are alternately opened to evaporate the liquid refrigerant. These operations of the first solenoid valve (36) and the second solenoid valve (37) will be described next.

When it is judged according to the detected values of the temperature sensor and the pressure sensor that the liquid refrigerant and the lubricant oil do not separate in two layers and the lubricant oil is kept in the appropriate condition, the first solenoid valve (36) is closed and the second solenoid valve (37) is opened. In other words, the gas container (35) communicates with the intake pipe (28) and the inside pressure of the gas container (35) is equal to the pressure in the intake pipe (28). Also, the inside pressure of the liquid retainer (31) is equal to the pressure of the gas refrigerant discharged from the compression mechanism (21).

To the contrary, when it is judged according to the detected values of the temperature sensor and the pressure sensor that the liquid refrigerant and the lubricant oil separate in two layers, the first solenoid valve (36) and the second solenoid valve (37) are alternately opened and closed to reduce the pressure in the liquid retainer (31) intermittently.

First, when the first solenoid valve (36) is opened and the second solenoid valve (37) is closed, the gas refrigerant in the liquid retainer (31) is introduced to the gas container (35) through the communication pipe (34) to reduce the inside pressure of the liquid retainer (31). When the inside pressure of the liquid retainer (31) is reduced, the liquid refrigerant in the high pressure chamber (23) flows into the liquid retainer (31) and the liquid refrigerant in the liquid retainer (31) is evaporated.

Next, when the first solenoid valve (36) is closed and the second solenoid valve (37) is opened, the liquid retainer (31) is disconnected from the gas container (35) and the gas container (35) communicates with the intake pipe (28). The gas refrigerant sucked out from the liquid retainer (31) to the gas container (35) is introduced to the intake pipe (28) through the communication pipe (34).

Thereafter, when the first solenoid valve (36) is opened and the second solenoid valve (37) is closed, the gas container (35), of which pressure has been reduced, communicates with the liquid retainer (31) to reduce the inside pressure of the liquid retainer (31). Accordingly, the liquid refrigerant in the high pressure chamber (23) flows into the liquid retainer (31) and the liquid refrigerant in the liquid retainer (31) is evaporated.

In this way, when the fist solenoid valve (36) and the second solenoid valve (37) are opened and closed, the liquid refrigerant retained in the high pressure chamber (23) is sent to the liquid retainer (31) and is evaporated. Repetition of the opening/closing operations of the first solenoid valve (36) and the second solenoid valve (37) gradually reduces the amount of the liquid refrigerant retained in the high pressure chamber (23).

It is noted that the alternate opening/closing operations of the solenoid valve (36) and the second solenoid valve (37) continue until it is judged according to the detected values of the temperature sensor and the pressure sensor that the two-layer separation of the lubricant oil and the liquid refrigerant is dissolved.

Effects of First Embodiment

As described above, conventionally, the refrigerant dissolving in the lubricant oil is gasified by heating the lubricant oil by means of a heater or the like wound around the casing (20) when the viscosity of the lubricant oil is lowered due to dissolution of the refrigerant into the lubricant oil. Therefore, considerable time is required for sufficiently increasing the temperature of the lubricant oil for viscosity recovery, during which the lubrication malfunction may cause damage to the compressor.

In order to tackle this problem, the operations of the first and second solenoid valves (36, 37) reduce the inside pressure of the liquid retainer (31) in the hermetic compressor (11) in the present embodiment. The reduction of the inside pressure of the liquid retainer (31) immediately reduces the pressure of the lubricant oil and also lowers the dissolubility of the refrigerant to the lubricant oil. Then, the refrigerant dissolving in the lubricant oil is gasified, with a result that the viscosity of the lubricant oil is recovered swiftly. Hence, according to the present embodiment, the refrigerant dissolving in the lubricant oil can be gasified and the viscosity thereof can be recovered in a shorter period than in the conventional cases. As a result, lubrication malfunction to be caused due to lowering of the viscosity of the lubricant oil by dissolution of the refrigerant therein can be surely avoided and the reliability of the hermetic compressor (11) can be enhanced.

Further, the first and the second solenoid valves (36, 37) operate to communicate the hermetic compressor (11) with the gas container (35), of which inside pressure has been reduced, thereby reducing the inside pressure of the liquid retainer (31). In other words, the liquid retainer (31) has no direct communication with the intake pipe (28) though the pressure of the liquid retainer (31) is reduced by utilizing the intake pipe (28) of lower pressure in the hermetic compressor (11). For this reason, the inside pressure of the liquid retainer (31) even under the low pressure state is not so lowered as the low pressure in the intake pipe (28), thereby preventing excessive flow of the lubricant oil into the liquid retainer (31). Thus, according to the present embodiment, excessive lowering of the oil level in the high pressure chamber (23) at pressure reduction in the liquid retainer (31) can be prevented and the oil supply path (30) composing the oil supply pump can continue to surely supply the lubricant oil in the high pressure chamber (23) to the compression mechanism (21).

Moreover, in the present embodiment, the liquid retainer (31) communicates with the hermetic compressor (11) at the level lower than the suction port of the oil supply path (30) composing the oil supply pump. Also, the liquid refrigerant in the high pressure chamber (23) flows into the liquid retainer (31) and is evaporated when the liquid refrigerant and the lubricant oil separate in two layers. Accordingly, the boundary between the liquid refrigerant and the lubricant oil is avoided not to be located above the level at which the high pressure chamber (23) communicates with the liquid retainer (31) even in the two-layer separation state, so that the lubricant oil is always sent to the oil supply path (30). Hence, according to the present embodiment, the liquid refrigerant in the two-layer separation is avoided from being sent to the compression mechanism (21) through the oil supply path (30), with a result that the lubrication malfunction in the compression mechanism (21) is surely avoided and the reliability of the hermetic compressor (11) is enhanced.

In addition, in the hermetic compressor (11) in the present embodiment, the gas refrigerant sucked from the liquid retainer (31) is combined with the refrigerant flowing toward the hermetic compressor (11) from the evaporator (14), and then, is sucked into the compression mechanism (21) through the intake pipe (28). The gas refrigerant sucked from the liquid retainer (31) has a higher enthalpy than that of the gas refrigerant to be sent toward the hermetic compressor (11) from the evaporator (14). For this reason, the combination with the gas refrigerant from the liquid retainer (31) increases the enthalpy of the refrigerant sucked by the compression mechanism (21), thereby increasing the temperature of the gas refrigerant discharged from the compression mechanism (21). Thus, heating efficiency of the gas refrigerant discharged to the high pressure chamber (23) with respect to the lubricant oil is enhanced, so that the temperature of the lubricant oil in the high pressure chamber (23) can be increased. Consequently, the present embodiment attains the effect that increase in temperature of the lubricant oil lowers the refrigerant dissolubility, which further prevents the lowering of the viscosity of the lubricant oil.

Second Embodiment

The second embodiment of the present invention is a modification of the pressure reduction means (50) in the hermetic compressor (11) of the first embodiment. Herein, the features different from those in the first embodiment will be described as the present embodiment.

Figure 6:
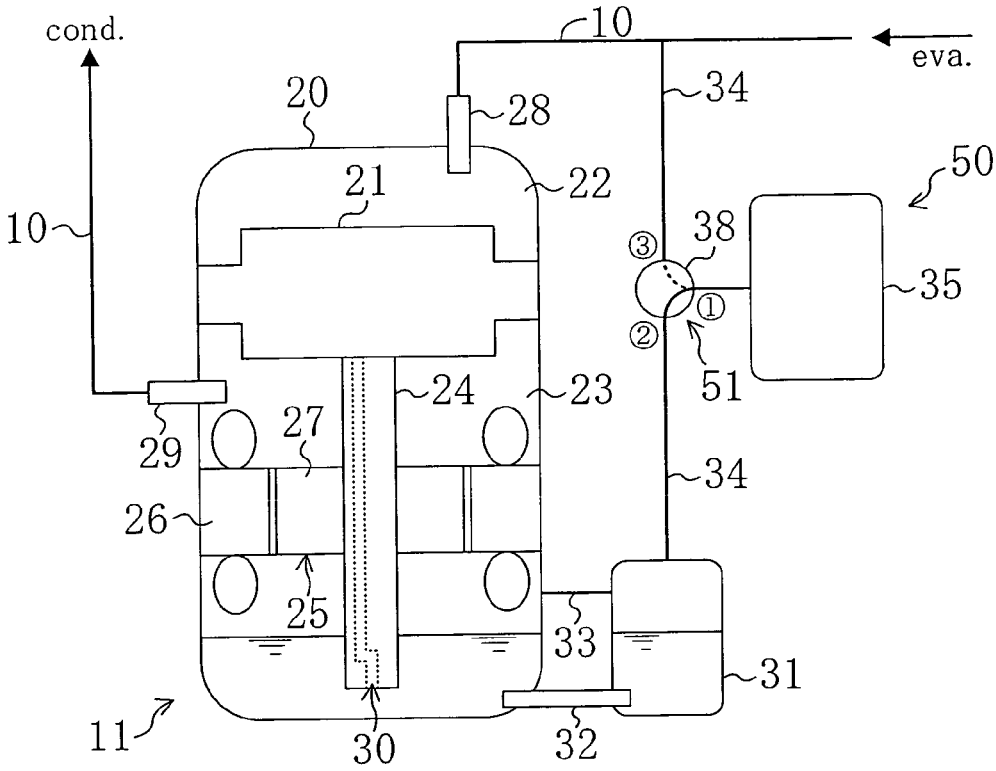
FIG. 6 is a schematic diagram showing the structure of a sealed compression according to a second embodiment.

As shown in FIG. 6, a three-way valve (38) is provided as the switching mechanism in the communication pipe (34) in the present embodiment. The gas container (35) in the present embodiment is connected to the communication pipe (34) via the three-way valve (38). Further, the communication pipe (34), the gas container (35) and the three-way valve (38) compose the pressure reduction means (50) in the present embodiment.

The three-way valve (38) is connected at a first port thereof to the gas container (35), at a second port thereof to the communication pipe (34) on the liquid retainer (31) side and at a third port thereof to the communication pipe (34) on the intake pipe (28) side. The three-way valve (38) switches the connection between the condition that only the second port communicates with the first port (state indicated by solid line in FIG. 5) and the condition that only the third port communicates with the first port (state indicated by broken line in FIG. 5).

When the viscosity of the lubricant oil obtained from the detected values of the temperature sensor and the pressure sensor is higher than the reference viscosity, the three-way valve (38) switches the connection to the condition that the third port communicates with the first port. Then, the gas container (35) communicates with the intake pipe (28), so that the inside pressure of the gas container (35) becomes equal to the pressure in the intake pipe (28). Also, the inside pressure of the liquid retainer (31) becomes equal to the pressure of the gas refrigerant discharged from the compression mechanism (21).

To the contrary, when the viscosity of the lubricant oil obtained from the detected values of the temperature sensor and the pressure sensor becomes lower than the reference viscosity, the three-way valve (38) switches the connection alternately between the condition that the second port communicates with the first port and the condition that the third port communicates with the first port, so as to reduce the pressure in the liquid retainer (31) intermittently.

First, when the three-way valve (38) switches the connection to the condition that the second port communicates with the first port, the gas container (35), of which pressure is low by the communication with the intake pipe (28), communicates with the liquid retainer (31). In association therewith, the gas refrigerant in the liquid retainer (31) is introduced to the gas container (35) through the communication pipe (34) to reduce the inside pressure of the liquid retainer (31). When the inside pressure of the liquid retainer (31) is reduced, the lubricant oil in the high pressure chamber (23) flows into the liquid retainer (31) and the pressure of the lubricant oil in the liquid retainer (31) is reduced, so that the dissolubility of the refrigerant to the lubricant oil is lowered. Accordingly, the refrigerant dissolving in the lubricant oil is gasified, with a result that the viscosity of the lubricant oil in the liquid retainer (31) is recovered.

Then, when the three-way valve (38) switches the connection to the condition that the third port communicates with the first port, the liquid retainer (31) is disconnected from the gas container (35) and the gas container (35) communicates with the intake pipe (28). The gas refrigerant sucked from the liquid retainer (31) to the gas container (35) is introduced to the intake pipe (28) through the communication pipe (34). Also, in this state, the gas refrigerant in the high pressure chamber (23) gradually flows into the liquid retainer (31) through the gas connection pipe (33), so that the inside pressure of the liquid retainer (31) gradually approximates to the inside pressure of the high pressure chamber (23). In association therewith, the oil level of the lubricant oil in the liquid retainer (31) is lowered to the oil level of the lubricant oil in the high pressure chamber (23). Then, the lubricant oil in the liquid retainer (31), of which viscosity has been recovered, is sent back to the high pressure chamber (23) through the oil return pipe (32).

Thereafter, when the three-way valve (38) switches the connection to the condition that the second port communicates with the first port, the gas container (35), of which pressure has been reduced, communicates with the liquid retainer (31) to reduce the inside pressure of the liquid retainer (31). In this association, the lubricant oil in the high pressure chamber (23) flows into the liquid retainer (31) and the pressure of the lubricant oil in the liquid retainer (31) is reduced, whereby the refrigerant dissolving in the lubricant is gasified and the viscosity of the lubricant oil is recovered. Then, when the three-way valve (38) switches the connection again to the condition that the third port communicates with the first port, the inside pressure of the liquid retainer (31) is increased and the lubricant oil in the liquid retainer (31), of which viscosity has been recovered, is sent back to the high pressure chamber (23).

Third Embodiment of the Invention

The third embodiment of the present invention is a modification of the pressure reduction means (50) in the hermetic compressor (11) of the first embodiment. Herein, the features different from those in the first embodiment will be described as the present embodiment.

Figure 7:
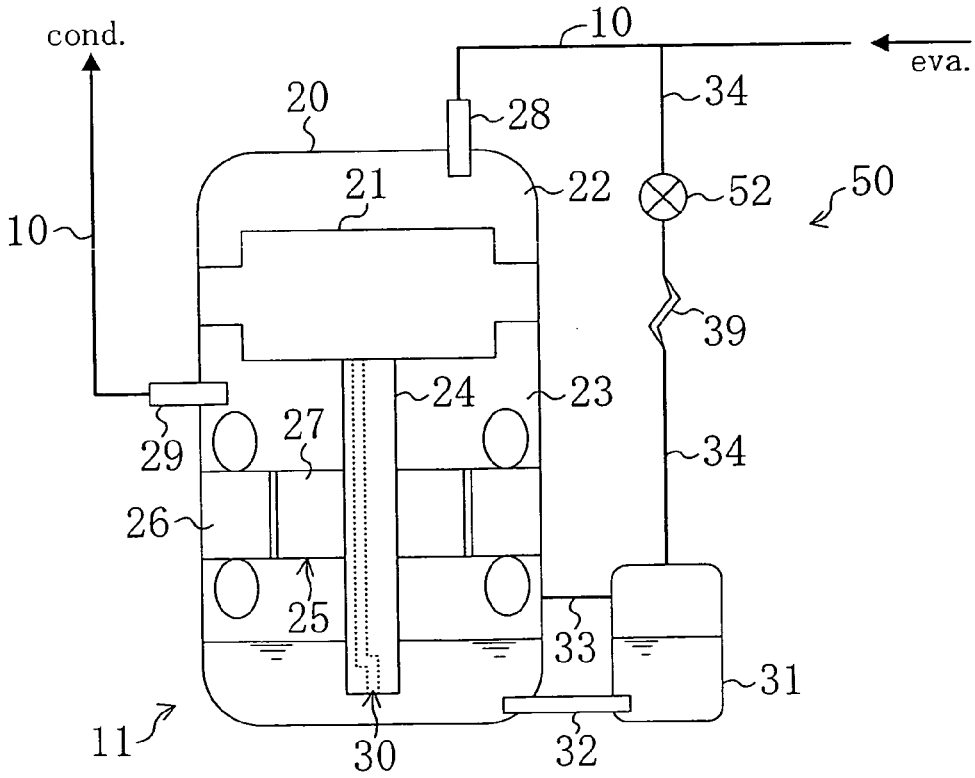
FIG. 7 is a schematic diagram showing the structure of a sealed compression according to a third embodiment

As shown in FIG. 7, a capillary tube (39) and a solenoid valve (52) are provided in the communication pipe (34) in the present embodiment. The solenoid valve (52) is arranged on the intake (28) side of the capillary tube (39) in the communication pipe (34). When the solenoid valve (52) is opened, the liquid retainer (31) and the intake pipe (28) communicate with each other through the capillary tube (39). The communication pipe (34), the capillary tube (39) and the solenoid valve (52) compose the pressure reduction means (50) in the present embodiment.

When the viscosity of the lubricant oil obtained from the detected values of the temperature sensor and the pressure sensor is higher than the reference viscosity, the solenoid valve (52) is closed. Namely, the liquid retainer (31) is disconnected from the intake pipe (28) and the inside pressure of the liquid retainer (31) is equal to the pressure of the refrigerant discharged from the compression mechanism (21).

To the contrary, when the viscosity of the lubricant oil obtained from the detected values of the temperature sensor and the pressure sensor becomes lower than the reference viscosity, the solenoid valve (52) is opened and closed to reduce the pressure in the liquid retainer (31) intermittently.

First, when the solenoid valve (52) is opened, the liquid retainer (31) and the intake pipe (28) communicate with each other. In association therewith, the gas refrigerant in the liquid retainer (31) is introduced to the intake pipe (28) through the communication pipe (34) to reduce the inside pressure of the liquid retainer (31). When the inside pressure of the liquid retainer (31) is reduced, the lubricant oil in the high pressure chamber (23) flows into the liquid retainer (31) and the pressure of the lubricant oil in the liquid retainer (31) is reduced, thereby lowering the dissolubility of the refrigerant to the lubricant oil. As a result, the refrigerant dissolving in the lubricant oil is gasified and the viscosity of the lubricant oil in the liquid retainer (31) is recovered.

Next, when the solenoid valve (52) is closed, the liquid retainer (31) is disconnected from the intake pipe (28). In this state, the gas refrigerant in the high pressure chamber (23) gradually flows into the liquid retainer (31) through the gas connection pipe (33) so that the inside pressure of the liquid retainer (31) approximates to the inside pressure of the high pressure chamber (23). In association therewith, the oil level of the lubricant oil in the liquid retainer (31) is lowered to the oil level of the lubricant oil in the high pressure chamber (23). Then, the lubricant oil in the liquid retainer (31), of which viscosity has been recovered, is sent back to the high pressure chamber (23) through the oil return pipe (32).

Thereafter, when the solenoid valve (52) is opened, the liquid retainer (31) communicates with the intake pipe (28) to reduce the inside pressure of the liquid retainer (31). Accordingly, the lubricant oil in the high pressure chamber (23) flows into the liquid retainer (31) and the pressure of the lubricant oil in the liquid retainer (31) is reduced, so that the refrigerant dissolving in the lubricant oil is gasified and the viscosity of the lubricant oil is recovered. When the solenoid valve (52) is closed again, the inside pressure of the liquid retainer (31) is increased so that the lubricant oil in the liquid retainer (31) is sent back to the high pressure chamber (23).

Fourth Embodiment

The fourth embodiment of the present invention is a modification of the pressure reduction means (50) in the hermetic compressor (11) of the first embodiment. Herein, the features different from those in the first embodiment will be described as the present embodiment.

Figure 8:
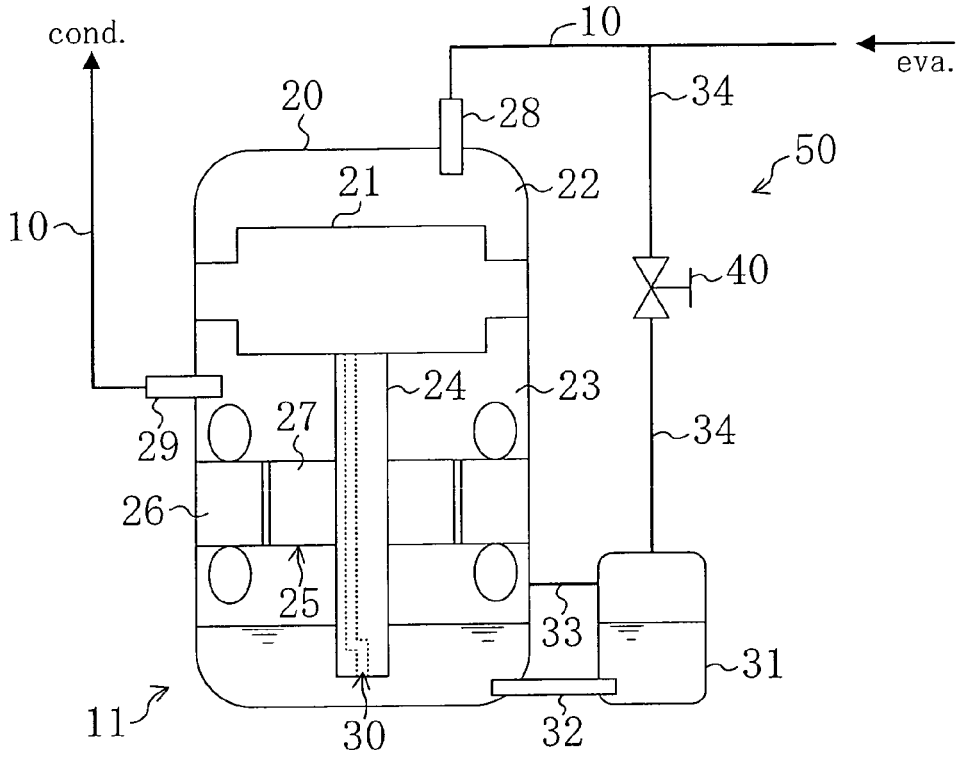
FIG. 8 is a schematic diagram showing the structure of a sealed compression according to a fourth embodiment.

As shown in FIG. 8, a motor operated expansion valve (40) as an adjuster valve capable of changing the degree of its opening is provided in the communication pipe (34) in the present embodiment. When the motor operated expansion valve (40) is opened, the liquid retainer (31) and the intake pipe (28) communicate with each other. The communication pipe (34) and the motor operated expansion valve (40) compose the pressure reduction means (50) in this embodiment.

When the viscosity of the lubricant oil obtained from the detected values of the temperature sensor and the pressure sensor is higher than the reference viscosity, the motor operated expansion valve (40) is closed. Accordingly, the liquid retainer (31) is disconnected from the intake pipe (28) and the inside pressure of the liquid retainer (31) is equal to the pressure of the refrigerant discharged from the compression mechanism (21).

To the contrary, when the viscosity of the lubricant oil obtained from the detected values of the temperature sensor and the pressure sensor becomes lower than the reference viscosity, the motor operated expansion valve (40) is opened to reduce the pressure in the liquid retainer (31).

When the motor operated expansion valve (40) is opened, the liquid retainer (31) and the intake pipe (28) communicate with each other. In association therewith, the gas refrigerant in the liquid retainer (31) is introduced to the intake pipe (28) through the communication pipe (34) to reduce the inside pressure of the liquid retainer (31). When the inside pressure of the liquid retainer (31) is reduced, the lubricant oil in the high pressure chamber (23) flows into the liquid retainer (31) and the pressure of the lubricant oil in the liquid retainer (31) is reduced, whereby the dissolubility of the refrigerant to the lubricant oil is lowered. Accordingly, the refrigerant dissolving in the lubricant oil is gasified and the viscosity of the lubricant oil in the liquid retainer (31) is recovered.

The degree of opening of the motor operated expansion valve (40) is adjusted during the period. The adjustment of the degree of opening of the motor operated expansion valve (40) is performed based on an output signal of the oil level sensor. Thus, the oil level of the lubricant oil in the high pressure chamber (23) is kept above the lower end of the drive shaft (24) so that the lubricant oil is surely supplied to the compression mechanism (21) through the oil supply path (30).

Fifth Embodiment

The fifth embodiment of the present invention is a modification of the hermetic compressor (11) of the first embodiment. In detail, the liquid retainer (31) and the oil return pipe (32) in the first embodiment are omitted and the pressure reduction means (50) plays a role for temporally lowering the inside pressure of the high pressure chamber (23). Herein, the features different from those in the first embodiment will be described as the present embodiment.

Figure 9:
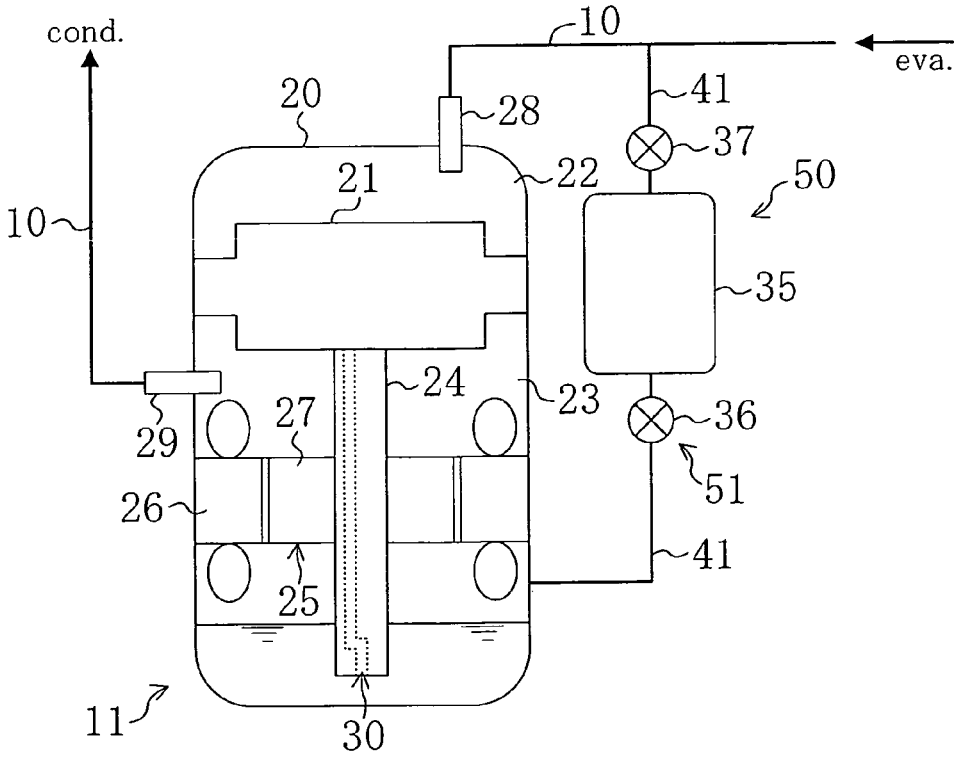
FIG. 9 is a schematic diagram showing the structure of a sealed compression according to a fifth embodiment.

As shown in FIG. 9, a pressure reducing pipe (41) is connected with the lower side part of the casing (20). One end of the pressure reducing pipe (41) is open at a part located always above the oil level in the high pressure chamber (23), that is, a part where the gas refrigerant exists in the high pressure chamber (23) all the time. The other end of the pressure reducing pipe (41) is connected to the intake pipe (28) via the refrigerant circuit (10).

The gas container (35) is arranged in the pressure reducing pipe (41) and is formed of a hollow cylinder in a sealed state. The gas container (35) is connected at the upper end and the lower end thereof to the pressure reducing pipe (41) and has the inner volume larger than that in the first embodiment.

The first and second solenoid valves (36, 37) are provided as opening/closing valves respectively at the sides of the gas container (35) in the pressure reducing pipe (41). In detail, the first solenoid valve (36) is arranged on the high pressure chamber (23) side of the gas container (35) and the second solenoid valve (37) is arrange on the intake pipe (28) side of the gas container (35) therein. The pressure reducing pipe (41), the gas container (35) and the first and second solenoid valves (36, 37) compose the pressure reduction means (50) for sucking the gas refrigerant in the high pressure chamber (23) in the present embodiment.

When the viscosity of the lubricant oil obtained from the detected values of the temperature sensor and the pressure sensor is higher than the reference viscosity, the first solenoid valve (36) is closed and the second solenoid valve (37) is opened. Accordingly, the gas container (35) communicates with the intake pipe (28) and the inside pressure of the gas container (35) is equal to the pressure in the intake pipe (28).

To the contrary, when the viscosity of the lubricant oil obtained from the detected values of the temperature sensor and the pressure sensor becomes lower than the reference viscosity, the first solenoid valve (36) and the second solenoid valve (37) are opened and closed alternately to reduce the pressure in the high pressure chamber (23) intermittently.

First, when the first solenoid valve (36) is opened and the second solenoid valve (37) is closed, the gas container, of which pressure is low by the communication with the intake pipe (28), is connected to the high pressure chamber (23). In association therewith, the gas refrigerant in the high pressure chamber (23) is introduced to the gas container (35) through the pressure reducing pipe (41) to reduce the inside pressure of the high pressure chamber (23). When the inside pressure of the high pressure chamber (23) is reduced, the dissolubility of the refrigerant to the lubricant oil is lowered. Therefore, the refrigerant dissolving in the lubricant oil is gasified and the viscosity of the lubricant oil in the high pressure chamber (23) is recovered.

Next, when the first solenoid valve (36) is closed and the second solenoid valve (37) is opened, the gas container (35) is disconnected from the gas container (35) and is connected to the intake pipe (28). The gas refrigerant sucked out from the high pressure chamber (23) to the gas container (35) is introduced to the intake pipe (28) through the pressure reducing pipe (41).

Thereafter, when the first solenoid valve (36) is opened and the second solenoid valve (37) is closed again, the gas container, of which pressure has been reduced, communicates with the high pressure chamber (23) to reduce the inside pressure of the high pressure chamber (23). Hence, the pressure of the lubricant oil in the high pressure chamber (23) is reduced and the refrigerant dissolving in the lubricant oil is gasified, thereby recovering the viscosity of the lubricant oil.

Another Embodiment of the Invention

An electric heater (53) may be provided in the hermetic compressor (11) in the first to fourth embodiments for heating the lubricant oil retained in the liquid retainer (31). Herein, the case where this modification is applied to the first embodiment will be described.

Figure 10:
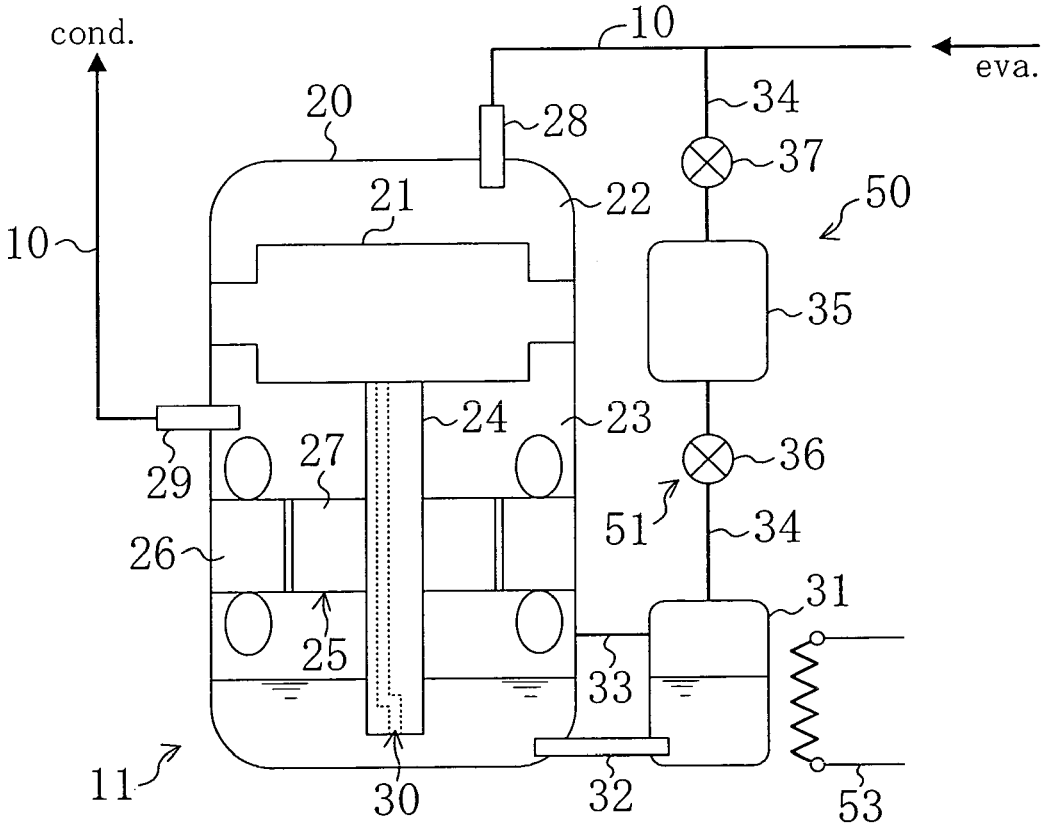
FIG. 10 is a schematic diagram showing the structure of a sealed compression according to another embodiment.

As shown in FIG. 10, the hermetic compressor (11) in this modified example is provided with the electric heater (53) along the side wall of the liquid retainer (31). By conducting the electric heater (53), the lubricant oil is heated via the liquid retainer (31).

In this modified example, when the viscosity of the lubricant oil obtained from the detected values of the temperature sensor and the pressure sensor is higher than the reference viscosity, the electric heater (53) is not conducted. To the contrary, the viscosity of the lubricant oil obtained from the detected values of the temperature sensor and the pressure sensor becomes lower than the reference viscosity, the electric heater (53) is conducted in addition to the opening/closing operations of the first and second solenoid valves (36, 37). When the lubricant oil is heated by the electric heater (53), the temperature of the lubricant oil is increased. Therefore, the dissolubility of the refrigerant to the lubricant oil is lowered, so that the refrigerant dissolving in the lubricant oil is gasified, with a result that the viscosity of the lubricant oil is recovered. Then, as described above, when the first solenoid valve (36) is closed and the second solenoid valve is opened, the lubricant oil in the liquid retainer (31), of which viscosity has been recovered, is sent back to the high pressure chamber (23) through the oil return pipe (32).

There is the case where the viscosity of the lubricant oil lowers due to dissolution of the refrigerant even during the halt of the hermetic compressor (11). Activation of the hermetic compressor (11) with the lubricant oil of lowered viscosity causes lubrication malfunction thereafter and may invite damage to the compression mechanism (21). For tackling this problem, the electric heater (53) is conducted before the activation of the hermetic compressor (11). When the lubricant oil is heated by the electric heater (53), the dissolubility of the refrigerant to the lubricant oil is lowered by the temperature increase, so that the refrigerant dissolving in the lubricant oil is gasified, with a result that the viscosity of the lubricant oil is recovered. The hermetic compressor (11) is activated after the viscosity of the lubricant oil is recovered by conducting the electric heater (53) so as to ensure the lubrication in the compression mechanism (21) immediately after the activation.

INDUSTRIAL APPLICABILITY

As described above, the present invention is useful for hermetic compressors.

The invention claimed is:

1. A hermetic compressor comprising:

a casing including a high pressure chamber, an intake pipe and a discharge pipe, the intake pipe supplying a refrigerant to the casing from an outlet of an evaporator, and the high pressure chamber communicating with the discharge pipe to supply high pressure refrigerant to a condenser;

a compression mechanism accommodated within the casing for sucking the refrigerant from the intake pipe, compressing the refrigerant, and discharging the refrigerant into the high pressure chamber, which contains lubricant oil at a bottom of the high pressure chamber that is supplied to the compression mechanism, a container member being a separate body from and communicating with a bottom part of the high pressure chamber so as to allow the lubricant oil to flow to and from the container member; and a pressure reduction device which sucks gas refrigerant in the container member and sends out the thus sucked gas refrigerant to the intake pipe for reducing an inside pressure of the container member, the pressure reduction device being in fluid communication with the intake pipe at a location between the outlet of the evaporator and an inlet of compression mechanism.

2. The hermetic compressor of claim 1, wherein the pressure reduction device is configured to suck the gas refrigerant in the container member intermittently.

3. The hermetic compressor of claim 2, wherein the pressure reduction device includes a gas container and a switching mechanism which switches connection between a condition that the gas container communicates only with the intake pipe and a condition that the gas container communicates only with the container member, and the pressure reduction device is further configured to operate the switching mechanism to conduct an operation for communicating the gas container with the intake pipe for pressure reduction alternately with an operation for communicating the gas container with the container member.

4. The hermetic compressor of claim 1, wherein the pressure reduction device includes a communication pipe connected to an upper end of the container member and the intake pipe at the location between the outlet of the evaporator and an inlet of compression mechanism, and a gas container disposed in the communication pipe between the upper end of the container member and the intake pipe, and the switching mechanism includes opening/closing valves arranged respectively on sides of the gas container in the communication pipe.

5. The hermetic compressor of claim 1, wherein the pressure reduction device includes a communication pipe connected to an upper end of the container member and the intake pipe and an adjuster valve arranged in the communication pipe and capable of changing a degree of opening thereof

6. The hermetic compressor of claim 1, further comprising an oil supply pump configured to suck the lubricant oil retained at the bottom of the high pressure chamber and supply the gas refrigerant to the compression mechanism, the container member communicating with the high pressure chamber at a part lower than a level at which the oil supply pump sucks the lubricant oil.

7. The hermetic compressor of claim 1, further comprising an electric heater is provided for heating liquid in the container member.

8. A refrigerator comprising:

a condenser;

an expansion valve that receives refrigerant from the condenser;

an evaporator that receives refrigerant from the expansion valve; and a hermetic compressor disposed between the condenser and the evaporator, the hermetic compressor including a casing including a high pressure chamber, an intake pipe and a discharge pipe, the intake pipe supplying refrigerant to the casing from an outlet of the evaporator, and the high pressure chamber communicating with the discharge pipe to supply high pressure refrigerant to the condenser, a compression mechanism accommodated within the casing for sucking the refrigerant from the intake pipe, compressing the refrigerant, and discharging the refrigerant into the high pressure chamber, which contains lubricant oil at a bottom of the high pressure chamber that is supplied to the compression mechanism, a container member being a separate body from and communicating with a bottom part of the high pressure chamber so as to allow the lubricant oil to flow to and from the container member, and a pressure reduction device which sucks gas refrigerant in the container member and sends out the thus sucked gas refrigerant to the intake pipe for reducing an inside pressure of the container member, the pressure reduction device being in fluid communication with the intake pipe at a location between the outlet of the evaporator and an inlet of compression mechanism.

9. The refrigerator of claim 8, wherein the pressure reduction device is configured to suck the gas refrigerant in the container member intermittently.

10. The refrigerator of claim 9, wherein the pressure reduction device includes a gas container and a switching mechanism which switches connection between a condition that the gas container communicates only with the intake pipe and a condition that the gas container communicates only with the container member, and the pressure reduction device is further configured to operate the switching mechanism to conduct an operation for communicating the gas container with the intake pipe for pressure reduction alternately with an operation for communicating the gas container with the container member.

11. The refrigerator of claim 8, wherein the pressure reduction device includes a communication pipe connected to an upper end of the container member and the intake pipe at the location between the outlet of the evaporator and an inlet of compression mechanism, and a gas container disposed in the communication pipe between the upper end of the container member and the intake pipe, and the switching mechanism includes opening/closing valves arranged respectively on sides of the gas container in the communication pipe.

12. The refrigerator of claim 8, wherein the pressure reduction device includes a communication pipe connected to an upper end of the container member and the intake pipe and an adjuster valve arranged in the communication pipe and capable of changing a degree of opening thereof.

13. The refrigerator of claim 8, further comprising an oil supply pump configured to suck the lubricant oil retained at the bottom of the high pressure chamber and supply the gas refrigerant to the compression mechanism, the container member communicating with the high pressure chamber at a part lower than a level at which the oil supply pump sucks the lubricant oil.

14. The refrigerator of claim 8, further comprising an electric heater is provided for heating liquid in the container member.

* * * * *

UNITED STATES PATENT AND TRADEMARK OFFICE

CERTIFICATE OF CORRECTION

PATENT NO. : 7,585,160 B2
APPLICATION NO. : 10/517142
DATED : September 8, 2009
INVENTOR(S) : Katsumi Hirooka et al.

It is certified that error appears in the above-identified patent and that said Letters Patent is hereby corrected as shown below:

On the title page change item [75] Inventors from

"[75] Inventors: Katsumi Hirooka, Sakai (JP);
Takashi Hikawa, Sakai (JP)"

to

-- [75] Inventors: Katsumi Hirooka, Sakai (JP);
Takeshi Hikawa, Sakai (JP) --

Signed and Sealed this

Second Day of March, 2010

David J. Kappos

David J. Kappos
*Director of the United States Patent and Trademark Office*